US006875126B2

(12) United States Patent
Yabu

(10) Patent No.: US 6,875,126 B2
(45) Date of Patent: Apr. 5, 2005

(54) GOLF CLUB HEAD

(75) Inventor: Masanori Yabu, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 10/303,909

(22) Filed: Nov. 26, 2002

(65) Prior Publication Data

US 2003/0119603 A1 Jun. 26, 2003

(30) Foreign Application Priority Data

Dec. 21, 2001 (JP) ..... 2001-390014

(51) Int. Cl.[7] ..... A63B 53/02; A63B 53/04
(52) U.S. Cl. ..... 473/305; 473/345
(58) Field of Search ..... 473/324, 290, 473/291, 345, 346, 349, 350, 342, 305, 306, 307, 308, 309, 310

(56) References Cited

U.S. PATENT DOCUMENTS 4,021,047 A * 5/1977 Mader ..... 473/345
4,432,549 A * 2/1984 Zebelean ..... 473/346
4,438,931 A * 3/1984 Motomiya ..... 473/346
5,704,850 A * 1/1998 Shieh ..... 473/324
6,299,549 B1 * 10/2001 Shieh ..... 473/342
6,506,129 B2 * 1/2003 Chen ..... 473/329
6,524,194 B2 * 2/2003 McCabe ..... 473/305
6,602,149 B1 * 8/2003 Jacobson ..... 473/329
6,648,774 B1 * 11/2003 Lee ..... 473/342
6,663,504 B2 * 12/2003 Hocknell et al. ..... 473/329
6,663,506 B2 * 12/2003 Nishimoto et al. ..... 473/345

FOREIGN PATENT DOCUMENTS

JP 5-317466 A 12/1993
JP 9-28842 A 2/1997
JP 2000-202075 A 7/2000

* cited by examiner

*Primary Examiner*—Sebastiano Passaniti
(74) *Attorney, Agent, or Firm*—Birch, Stewart, Kolasch & Birch, LLP

(57) ABSTRACT

A golf club head containing a hollow main frame and a face plate; the hollow main frame is composed of a main body and a crown plate welded to the main body, the main body containing a hosel part, a sole part and a side part extending upwards from the periphery of the sole part except for a front edge of the sole part thereby providing an open top and an open front, and the crown plate covers said open top, whereby the main frame has an opening on the front thereof. The face plate is welded to the main frame to cover the front opening of the main frame; the face plate includes a face part defining a clubface, and a flange part extending backward from at least the upper edge of the face part; the main frame further including eaves extending from an upper edge of the opening to the inside of the flange part, wherein the thickness of crown plate is in the range of 0.3 to 1.5 mm.

15 Claims, 9 Drawing Sheets

GOLF CLUB HEAD

BACKGROUND OF THE INVENTION

The present invention relates to a golf club head, more particularly to an overall structure capable of minimizing the overall thickness of the crown portion without causing a defect during welding.

In recent years, golf clubs such as metal woods have been increased in club head volume to meet the requirements of the marketplace, and in order to prevent a weight increase accompanying the increase in head volume, light metals and light alloys are widely used.

On the other hand, the position of the gravity point and the moment of inertia of the club head are very important parameters for improving carry distance, feel, handling and the like. These parameters can be adjusted by changing the weight distribution, and the weight distribution can be changed by changing the thickness distribution of various parts of the head.

In case of a club head having a large volume, the head is formed as a hollow body, and generally its major part is formed by casting with a metal material. The metal material suitable for casting however, are limited, and in such a material, the minimum thickness necessary for achieving durability, strength, rigidity and the like becomes relatively large when compared with other materials which are not suitable for casting but rather for plastic forming, and also it is difficult to shift the weight to a desired position. In other words, in the casting of such metal material, there is no extra weight to shift. Therefore, the design freedom is considerably limited.

SUMMARY OF THE INVENTION

It is therefore, an object of the present invention to provide a golf club head, in which the thickness of the crown portion is minimized to reduce its weight so as to be able to utilize the reduced weight for adjusting the position of the gravity point and the moment of inertia and the like, and thus increase the design freedom of the golf club.

According to the present invention, a golf club head comprises a hollow main frame composed of a main body and crown plate welded to the main body, wherein the main body includes a hosel part, a sole part and a side part extending upwards from the periphery of the sole part, except for a front edge of the sole part, thereby defining an open top and an open front, and a crown plate for covering the open top, whereby the main frame has an opening on the front thereof, a face plate welded to the main frame to cover said opening on the front of the main frame, wherein the face plate comprises a face part defining a clubface, and a flange part extending backward from at least an upper edge of the face part, the main frame further comprising eaves extending from an upper edge of the opening to the inside of said flange part, and the thickness of the crown plate is in a range of from 0.3 to 1.5 mm.

BRIEF DESCRIPTION OF THE DRAWINGS

The present invention will become more fully understood from the detailed description given herein below and the accompanying drawings, which are given by way of illustration only, and thus are not limitative of the present invention.

DESCRIPTION OF THE PREFERRED EMBODIMENTS

Figure 1:
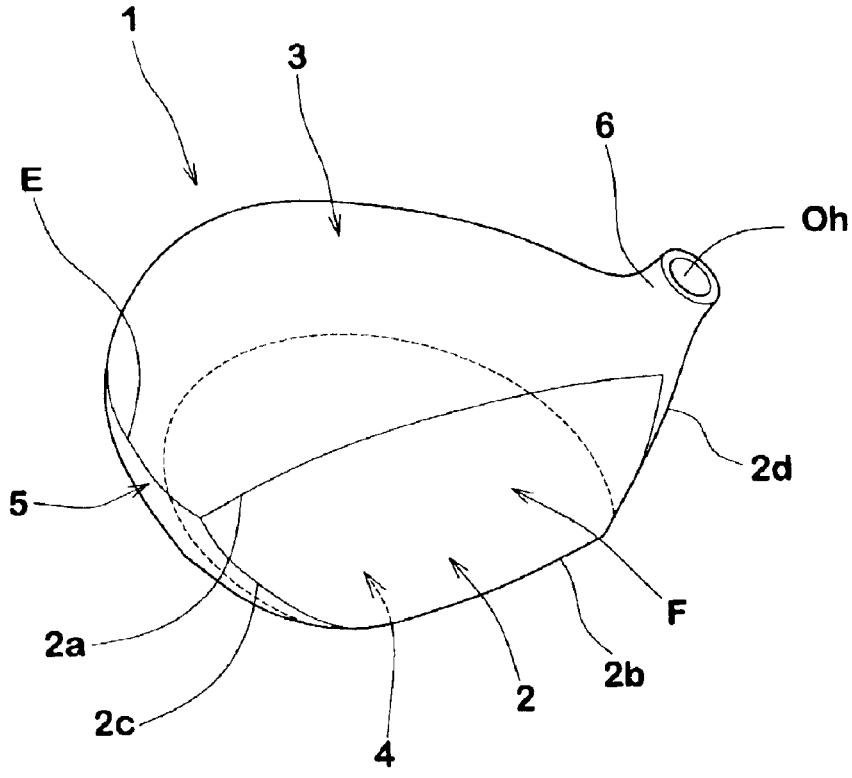
FIG. 1 is a perspective view of a club head according to the present invention.

Embodiments of the present invention will now be described in detail in conjunction with the accompanying drawings.

In the drawings, golf club head 1 according to the present invention is a wood-type hollow metal head whose volume is not less than 300 cc.

In general, if the head volume exceeds 250 cc, thickness reduction is required in various parts to prevent the club head weight from increasing. Therefore, the present invention is suitably applied to a club head whose volume is more than 250 cc, more suitably more than 280 cc, still more suitably or effectively more than 300 cc.

The club head 1 comprises, as shown in FIG. 1, a face portion 2 of which front surface defines a clubface F for striking a ball and rear face faces cavity (i), a crown portion 3 extending backwards from the upper edge 2*a* of the face portion 2, a sole portion 4 extending backwards from the lower edge 2*b* of the face portion 2, a side portion 5 which extends between the crown portion 3 and sole portion 4 in the vertical direction and between the toe-side edge 2*c* and the heel-side edge 2*d* of the face portion 2 through the back in the lateral direction, and a hosel 6 having an opening (Oh) for inserting a club shaft.

Figure 2:
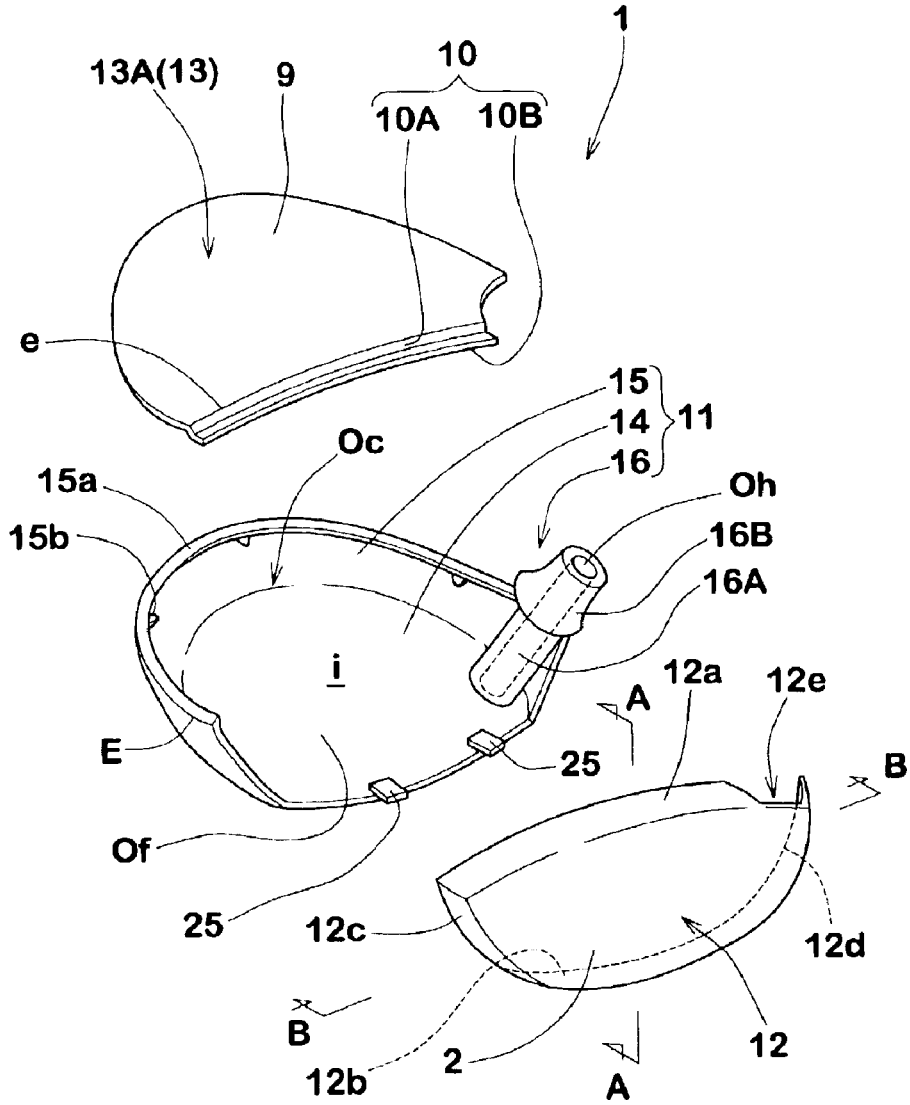
FIG. 2 is an exploded perspective view of the club head showing a three-piece structure.
Figure 5:
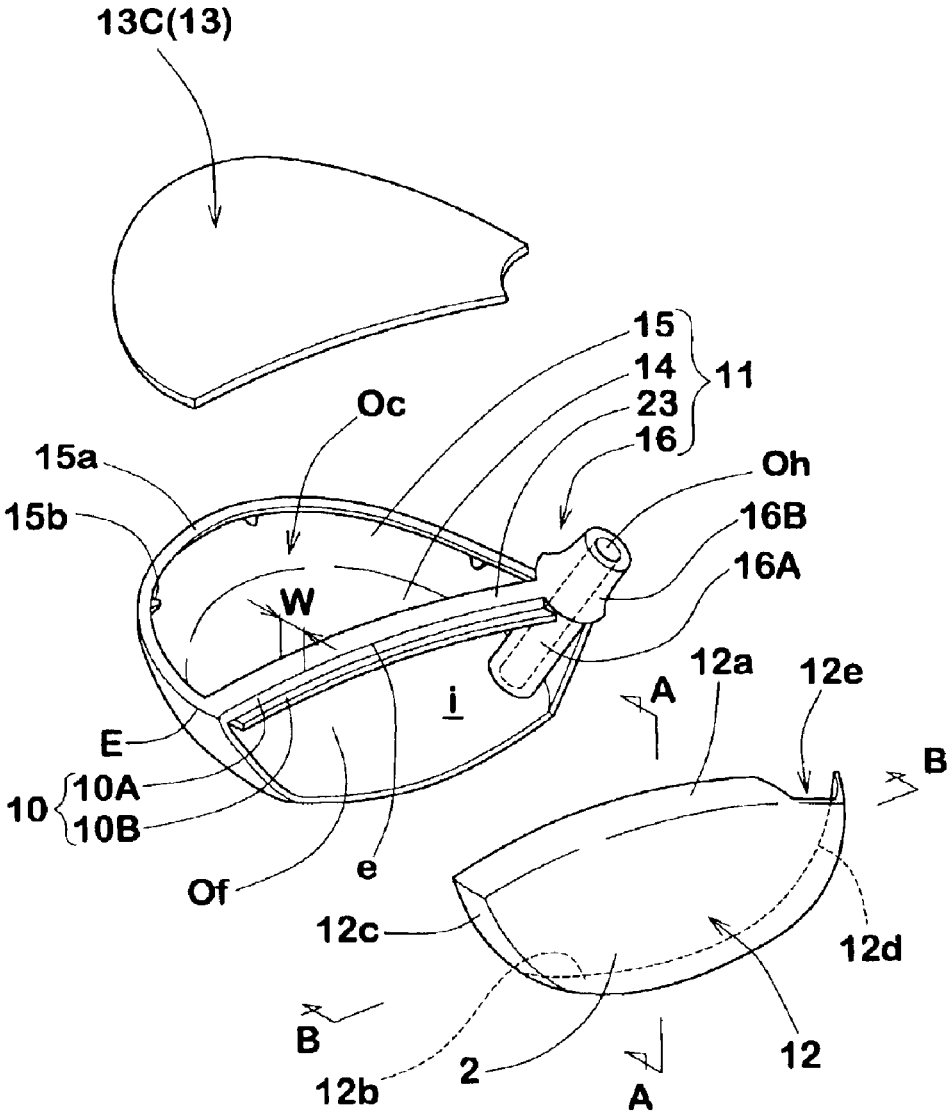
FIG. 5 is an exploded perspective view of the club head showing another example of the three-piece structure.

In the following embodiments, as shown in FIG. 2 and FIG. 5, the club head 1 is basically made up of three pieces, that is, a main body 11, a face plate 12 and a very thin crown plate 13.

The main body 11 and crown plate 13 are assembled and welded to each other to form a hollow main frame having an opening (Of) on the front thereof. The face place 12 is also welded to the main frame to cover the opening (Of).

Face Plate

The face plate 12 comprises a flat or slightly curved main part which defines the face portion 2, and a flange part 12*a* extending backward from the upper edge 2*a* of the face portion 2. In this example, further, a flange part 12*b*, a flange part 12*c* and a flange part 12*d* are provided so as to extends backward from the lower edge 2*b*, toe-side edge 2*c* and heel-side edge 2*d*, respectively. In other words, the face plate 12 in this example is, as shown in FIG. 2 and FIG. 5, provided with a flange part extending continuously along the almost entire circumference of the face portion 2 excepting a part 12*e* which must overlap the hosel part 16. Thus, this flange part has a dent 12*e* at the position corresponding to the hosel 6. The flange parts 12*a*, 12*b*, 12*c* and 12*d* form front parts of the crown portion 3, sole portion 4, side portion 5 on the toe-side, and side portion 5 on the heel-side, respectively.

The width L of the flange part (12*a*, 12*b*, 12*c*, 12*d*) measured along its surface from the edge (2*a*, 2*b*, 2*c*, 2*d*) is set in a range of from 5 to 30 mm, preferably 8 to 20 mm, more preferably 10 to 15 mm.

The face plate 12 is made of a high strength titanium alloy to reduce the thickness and thereby to improve the rebound performance. The face plate 12 is formed by plastic forming, specifically hot forging using the following material. For example, titanium alloys, e.g. Ti-15V-3Al-3Sn-3Cr which are higher in tensile strength than Ti-6Al-4V, alpha-beta-type titanium alloys such as Ti-4.5Al-3V-2Fe-2Mo, beta-type titanium alloys such as Ti-10V-2Fe-3Al and Ti-22V-4Al and the like are preferably used although these materials are not suitable for casting. Depending on the material used, the width L and the like, it may be also possible to use cold forging or pressing aside from the hot forging.

Figure 6A:
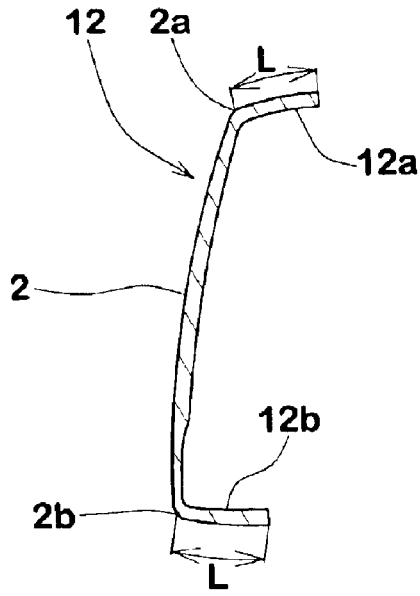
FIGS. 6A and 6B are cross sectional views of a face plate taken along lines A—A and B—B, respectively, in FIGS. 2 and 5.
Figure 6B:
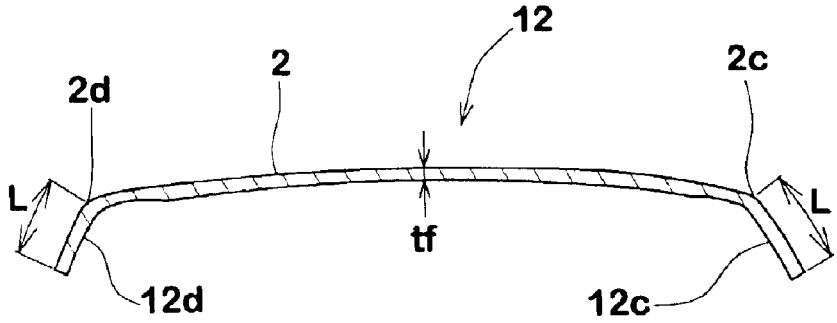

As to the thickness of the face plate 12, as shown in FIGS. 6A and 6B, the thickness (tf) in the face portion 2 is preferably set in a range of from 2.0 to 3.5 mm, more preferably 2.0 to 3.0 mm. If the thickness (tf) is more than 3.5 mm, it becomes difficult to improve the rebound performance. If the thickness (tf) is less than 2.0 mm, it is difficult to maintain necessary durability and strength.

As the flange part 12*a*–12*d* is formed by bending its thickness is substantially same as that of the face portion 2, namely in the range of from about 2.0 mm to about 3.5 mm.

The flange part 12*a*–12*d* distances the undermentioned weld junction from the face portion 2. Accordingly, the impulsive force received by the face portion 2 when hitting a ball is dispersed and the amplitude is decreased at the weld junction. As a result, it becomes possible to improve the durablity or decrease the thickness in the vicinity of the junction. Further, the elastic deformation of the face portion may be enhanced and the rebound performance 2 may be further improved.

Crown Plate

The crown plate 13 is a very thin part. To obtain a necessary strength, rigidity, durability and the like, the titanium alloys such as Ti-4.5Al-3V-2Fe-2Mo, Ti-10V-2Fe-3Al, Ti-22V-4Al, Ti-15V-3Al-3Sn-3Cr and Ti-6Al-4V mentioned above are preferably used.

The thickness (tc) is preferably set in a rage of from 0.3 to 1.5 mm, more preferably 0.3 to 0.8 mm, still more preferably 0.5 to 0.8 mm. If the thickness (tc) is less than 0.3 mm, it is difficult to obtain the necessary strength and durability. If the thickness (tc) is more than 1.5 mm, it is unavoidable in that the gravity point is heightened.

The crown plate 13 is also formed by plastic forming, specifically by pressing a metal plate. As the metal plate, a rolled plate is preferably used because the rolled plate has a compact crystal structure, and as a result, it is possible to obtain high strength stably. The thickness (tc) of the crown plate 13 is thus constant over all. Aside from the pressing of a metal plate, forging may be also available depending on the material used.

Main Body

The above-mentioned main body 11 is composed of a basal sole part 14 to define a major part of the sole portion 4, a side part 15 extending upward from the edge of the sole part 14 excepting the front edge thereof so as to extend laterally from the toe to the heel, a hosel part 16 to form the hosel 6, and optionally a traverse part 23 (shown in FIG. 5). The main body 11 accordingly has an open top and an open front. In case the traverse part 23 is not provided, as shown in FIG. 2, a front opening of and an upper opening (Oc) are continued. In case the traverse part 23 is provided, as shown in FIG. 5, a front opening of and an upper opening (Oc) are separated by the traverse part 23.

The hosel part 16 is a tubular part having a hole whose upper end defines the above-mentioned opening (Oh) for inserting a club shaft. In this example, the hosel part 16 comprises an upper neck part 16B thickening downward, and a lower anchor part 16A extending obliquely into the cavity (i) of the clubhead.

At the upper end of the side part 15, a narrow-width part 15*a*, which extends into the crown portion 3 from the edge E between the crown portion 3 and side portion 5, is formed to form a peripheral part of the crown portion 3 and to define the upper opening (Oc).

Further, in order to receive the underside of the crown plate 13 and also for the purpose of positioning of the crown plate 13 during assembling, ledges 15*b* protruding into the upper opening (Oc) are formed around the upper opening (Oc).

The main body 11 is formed by casting a metal material, specifically employing a lost-wax precision casting. As the metal material for the main body 11, titanium alloys such as Ti-6Al-4V are preferably used for its suitability for casting, high strength and low specific gravity.

The thickness of the main body 11 is set in a range of from about 0.8 mm to about 3.5 mm with the exception of the hosel part 16, ledges 15*b*, corner and their vicinities. If the thickness is less than 0.8 mm, it becomes difficult to completely fill the mold cavity with the molten metal. If the thickness exceeds 3.5 mm, the weight of the club head increases unfavorably and it becomes difficult to obtain good weight balance, moment of inertia and the like.

In order to render the gravity point of the club head lower and/or deeper, it is possible to change the thickness continuously or stepwise for example such that the side part 15 becomes gradually thicker from the upper end to the lower end, the sole part 14 is thicker than the side part 15, and/or the sole part 14 becomes gradually thicker from the front edge towards the backside.

Structure Shown in FIG. 2

In FIG. 2, as the main body 11 is not provided with the traverse part 23, the crown plate 13A extends to the front end of the main body 11 defining the upper edge (e) of the front opening (Of).

Figure 3:
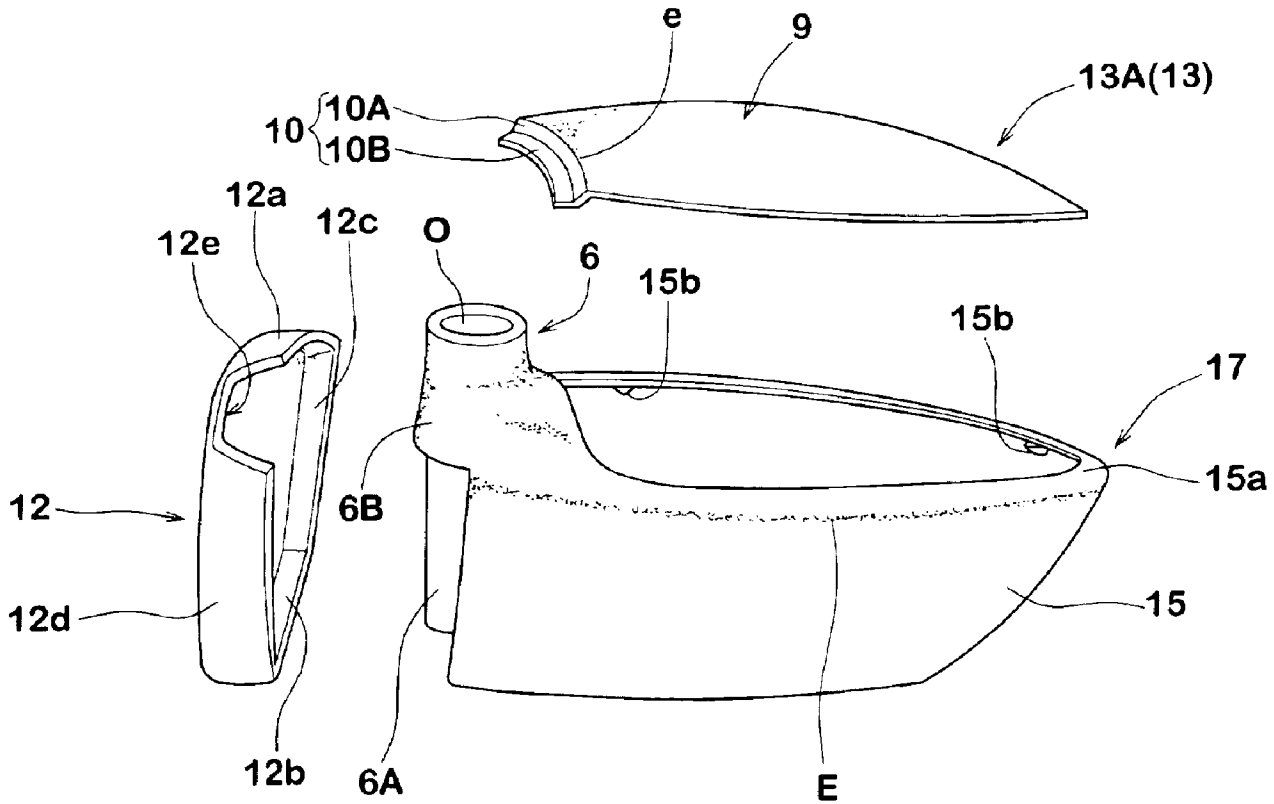
FIG. 3 is an exploded perspective view showing the same three-piece structure at another viewing angle.
Figure 4:
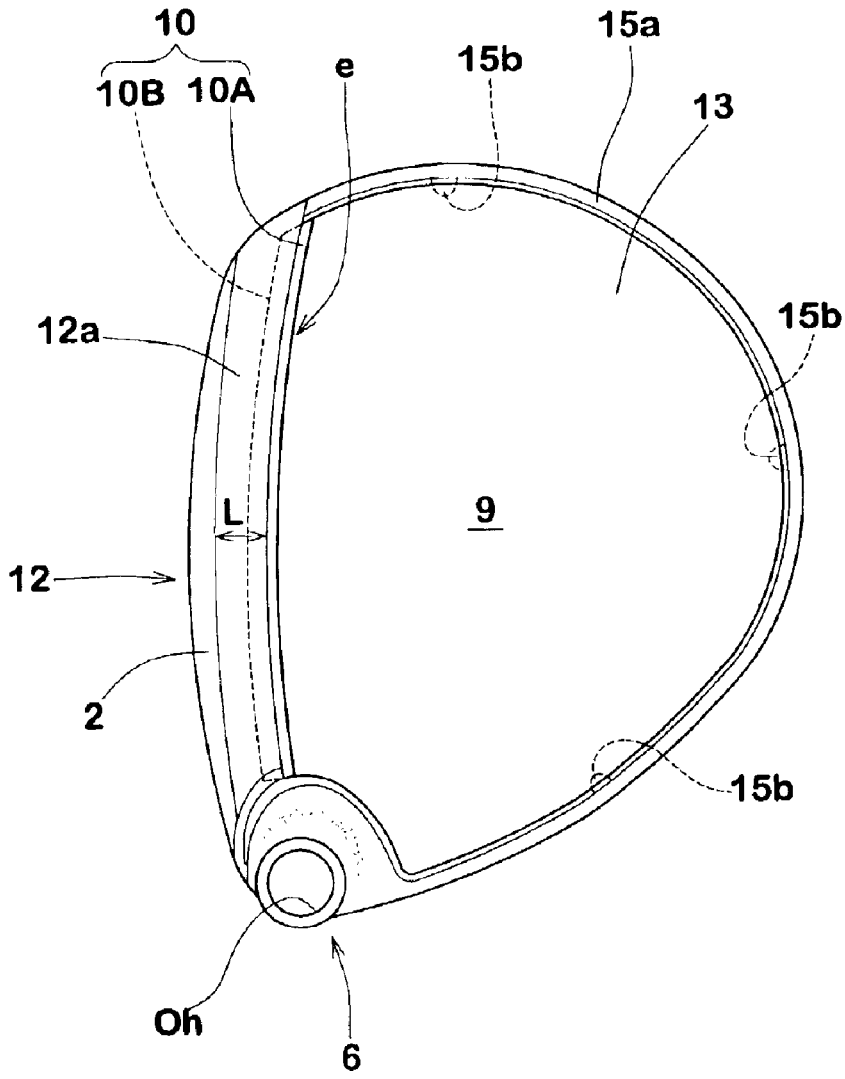
FIG. 4 is a top view of the club head in such a state that the three pieces are assembled but not yet welded each other.

Eaves 10 is provided along the upper edge (e) of the front opening (Of), namely, the front end of the crown plate 13A as shown in FIG. 2 and FIG. 3.

The eaves 10 comprises a part 10A extending downward from the edge (e) to the inside 12*ai* of the flange part 12*a* (hereinafter the "downwardly extending part 10A") and a part 10B extending forward from the lower end of the downwardly extending part 10A along the inside 12*ai* in direct contact with the inside 12*ai* (hereinafter the "backing part 10B").

The front surface 10A1 of the downwardly extending part 10A forms an angle θ of from 45 to 90 degrees, preferably 45 to 75 degrees with respect to the tangential direction to the surface of the crown portion at the edge (e) in a cross section perpendicular to the extending direction of the edge (e) as shown in FIGS. 7–10.

In the example shown in FIGS. 2, 3 and 7, the downwardly extending part 10A extends forward obliquely and the front surface 10A1 is accordingly inclined at an angle θ (for example about 60 degrees). However, the opposed rear end face 12*a*2 of the flange part 12*a* is perpendicular. Therefore, between the front surface 10A1 and rear end face 12*a*2, a V-shaped groove (j) opening in the crown portion 3 is formed.

Figure 7A:
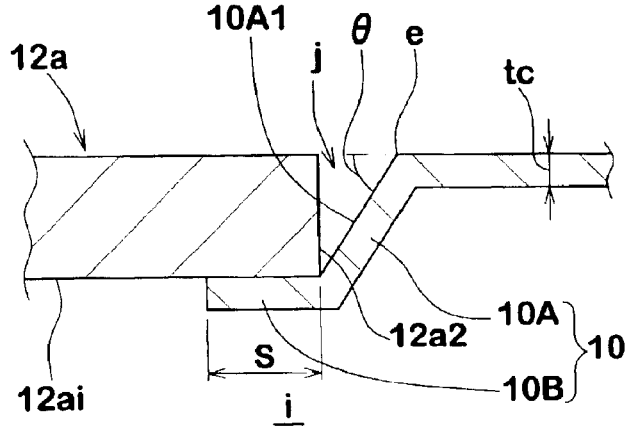
FIGS. 7A, 7B and 7C are enlarged cross sectional views showing an example of the joint structure for the face plate and a joint process by welding.
Figure 7B:
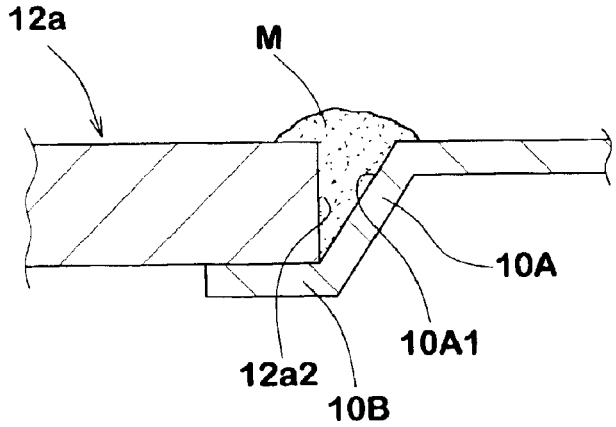

Thus, by welding as shown in FIG. 7B, a sufficient, stable joint surface area may be obtained to improve the bonding strength using a sufficient amount of welding metal M in the V-shaped groove (j).

On the other hand, due to the presence of the eaves 10, the crown plate 13A is provided with a bent shape and the rigidity thereof is increased and the strength and rigidity at the junction can be improved.

Figure 8:
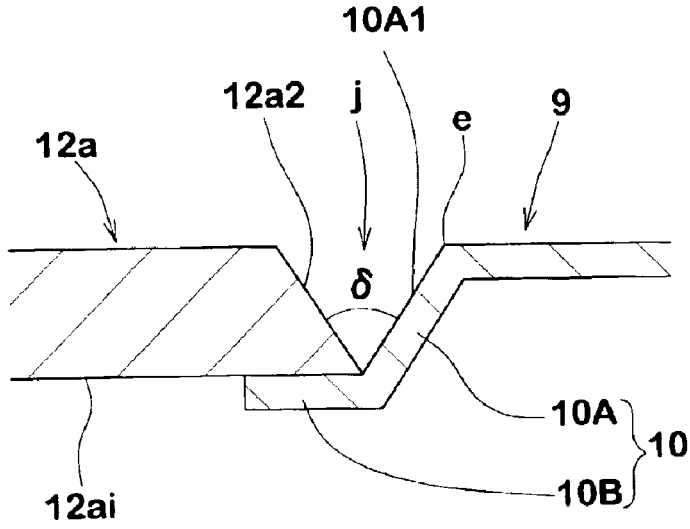
FIGS. 8, 9 and 10 are enlarged cross sectional views each showing another example of the joint structure for the face plate.

In FIG. 8 showing a modification of the joint part, in order to increase the opening angle δ of the V-shaped groove (j), both of the front surface 10A1 and the opposed rear end face 12*a*2 are formed as a down slope.

Figure 9:
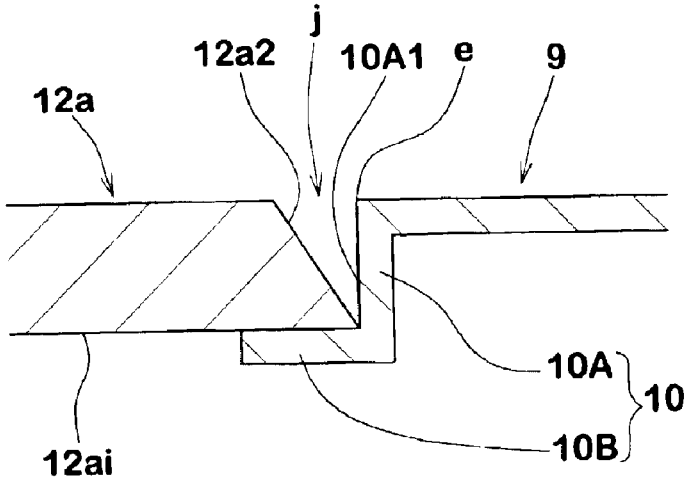

In FIG. 9 also showing a modification, the rear end face 12*a*2 of the flange part 12*a* is formed as a down slope. But the downwardly extending part 10A and its front surface 10A1 are substantially perpendicular, namely, substantially 90 degrees with respect to the above-explained tangential direction.

As shown in FIGS. 7A, 8 and 9, when at least one of the front surface 10A1 and the rear end face 12A2 is formed as a down slope, the positioning in assembling the face plate 12 can be made by a collision between the lower edge of the front surface 10A1 and the lower edge of the rear end face 12A2.

Figure 10:
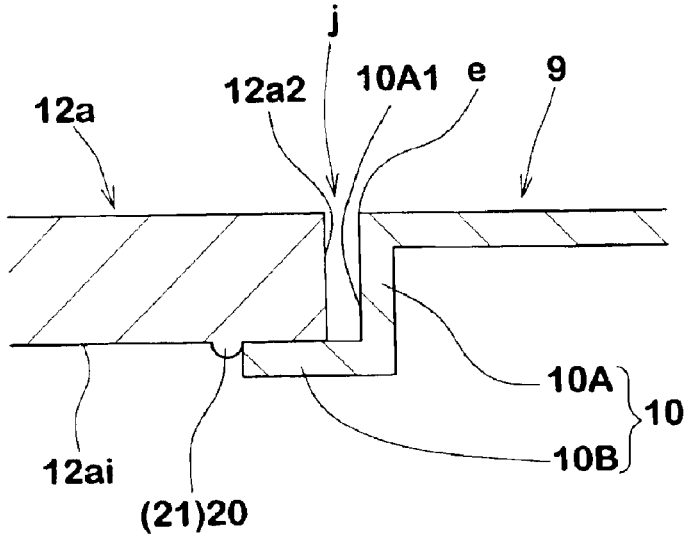

In FIG. 10 showing still another modification, the downwardly extending part 10A and its front surface 10A1 are substantially perpendicular similar to the example in FIG. 9. Further, the rear end face 12*a*2 of the flange part 12*a* is also substantially perpendicular.

In this case, in order to stably form a constant-width groove (j) between the front surface 10A1 and rear end face 12*a*2, a stopper 20 is protrudingly formed on the inner surface 12*ai* of the flange part 12*a* or the outer surface of the backing part 10B. In FIG. 10, the stopper 20 is formed on the inner surface 12*ai* so as to come into contact with the front end of the backing part 10B.

In any case, the width s of the backing part 10B is preferably not less than 2 mm, more preferably not less than 3 mm but preferably not more than 10 mm, more preferably not more than 5 mm. If the width s of the backing part 10B is less than 2 mm, it becomes unstable to support and position the flange part 12*a*. Further, in the case without the traverse part 23 in particular, the rigidity of the crown portion 3 around the junction tends to become insufficient.

It is preferable that the eaves 10 extends continuously through the substantially entire length of the edge (e). However, it may be possible to provide the eaves 10 discontinuously.

Figure 11:
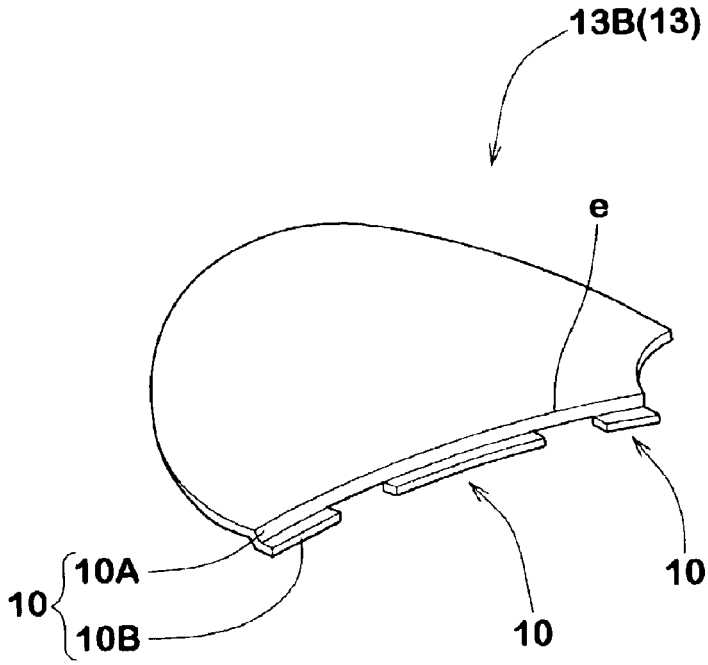
FIG. 11 is a perspective view of a crown plate which is a modification of the crown plate shown in FIG. 2 and also shows an example of discontinuous eaves in contrast to the continuous eaves shown in FIGS. 2 and 5.

FIG. 11 shows another example 13B of the crown plate 13 which has discontinuous eaves 10. In case of discontinuous eaves 10, it is preferable that even in a position where the backing part 10B is not formed, the downwardly extending part 10A is formed as shown in FIG. 11.

In either case (continuous or discontinuous), it is preferable that the total length of the downwardly extending part 10A and the total length of the backing part 10B are each in a range of not less than 50%, more preferably more than 80% of the length of the edge (e).

Structure Shown in FIG. 5

As explained above, a major difference from the former example shown in FIG. 2 is that the main body 11 is provided with a traverse part 23.

The traverse part 23 is located between the upper opening (Oc) and front opening (Of) and extends from the toe to the heel (practically to the neck part 16B). The traverse part 23 has a width w of from about 3 mm to about 5 mm and a thickness of from 0.3 to 1.5 mm preferably 0.8 to 1.5 mm and forms a part of the crown portion 3. The upper edge (e) of the front opening (Of) is defined by the front edge of this traverse part 23.

In this example too, the above-mentioned eaves 10 is formed at the upper edge (e) of the front opening (of), namely, the front edge of the traverse part 23. Thus, the crown plate 13C in this example is a simple, flat or slightly curved plate. on the other hand, at the rear edge of the traverse part 23, the above-mentioned ledge 15*b* is provided in order to receive the under side of the front edge of the crown plate 13C.

As to the eaves 10 and the rear end face 12A2 of the face plate 12, the above-mentioned various types shown in FIGS. 7A, 8, 9 and 10 (oblique/perpendicular) and FIGS. 2 and 11 (continuous or discontinuous) can be employed.

In case of the example shown in FIG. 2, first the crown plate 13 is welded to the main body 11 while putting the crown plate 13 on the ledges 15*b*, whereby a hollow main frame having the opening (Of) on its front is made.

Then, the face plate 12 is positioned on the front of the main frame using the eaves 10 (to be concrete, putting the flange part 12*a* on the backing part 10B).

Figure 7C:
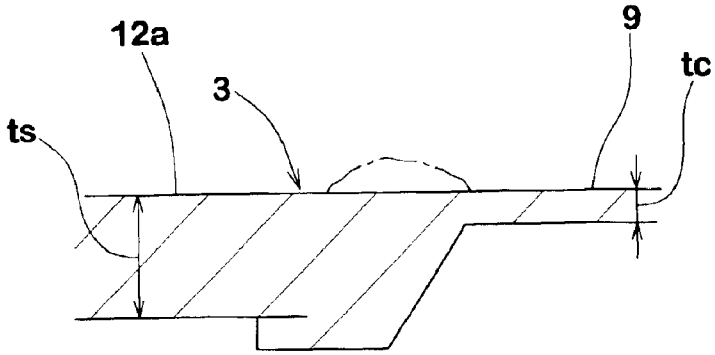

And the flange part 12*a*–12*d* is welded to the front edges of the crown plate 13A, sole part 14 and side part 15 as shown in FIG. 7B. The rising welding metal M is removed by polishing to flatten the weld junction so that the surface of the weld junction smoothly connects the surface of the crown plate 13 to the surface of the flange part 12*a* as shown in FIG. 7C.

In case of the example shown in FIG. 5, the crown plate 13 and the face plate 12 are welded to the main body 10 likewise, but the order of welding the crown plate 13 and the face plate 12 to the main body may be reversed.

Incidentally, for the purpose of supporting and positioning the inner surface of the flange part 12*b* on the sole-side of the face plate 12, as shown in FIG. 2, projections 25 may be provided at the front edge of the sole part 14.

As to the ledge 15*b* for receiving and positioning the crown plate 13, it is also possible to provide a single ledge 15*b* instead of a plurality of the discontinuous ledges 15*b*.

Such a single ledge 15*b* may extend continuously along the circumference of the upper opening (Oc) in case the traverse part 23 is provided. In case the traverse part 23 is not provided, the single ledge 15*b* may extend continuously along the edge of the narrow-width part 15*a* at the upper end of the side part 15.

Comparison Tests

Wood type golf club heads of the substantially same outer shape having a head volume of 320 cc and a weight of 186 grams were made. The club heads had the substantially same three-piece structure shown in FIG. 2 with the exception of the eaves 10. The main body 11 was made of a titanium alloy Ti-6Al-4V using vacuum precision casting. The face plate 12 was made of a titanium alloy Ti-4.5Al-3V-2Fe-2Mo using hot forging. The crown plate 13 was made of a titanium alloy showing in Table 1 using die punching. The thickness of the crown plate 13 was constant over all including the eaves 10 if any.

The club heads were tested as follows. Test results are shown in Table 1 together with the specifications of the crown plates.

Durability Test

The club head was attached to a FRP shaft to make a 46 inch wood club, and the golf club was mounted on a swing robot. The club head struck two-piece balls 3000 times at the head speed of 54 meter/second. Thereafter the clubface was checked for deformation and/or damage. The numerical value shown in Table 1 means that the face portion 2 was broken by hitting of that value.

Defective Test

The percent defective in making the crown plate, the percent defective due to irregularity caused in the crown portion by welding, and the percent defective due to failure in positioning of the face plate during welding were checked. Practically, an acceptable maximum level may be about 5%.

TABLE 1

| Head | Ref.1 | Ref.2 | Ref.3 | Ex.1 | Ex.2 | Ex.3 | Ex.4 | Ex.5 | Ex.6 |
|---|---|---|---|---|---|---|---|---|---|
| Crown plate 13 | | | | | | | | | |
| Material (*1) | A | A | A | A | A | A | A | C | B |
| Thickness tc (mm) | 0.8 | 0.8 | 0.3 | 0.8 | 0.8 | 0.8 | 0.5 | 0.8 | 0.8 |
| Part 10A of Eaves | | | | | | | | | |
| Angle θ (deg) | — | — | 75 | 90 | 75 | 45 | 75 | 75 | 75 |
| Width (mm) | — | — | 1.55 | 1.5 | 1.55 | 2.12 | 1.55 | 1.55 | 1.55 |
| Part 10B of Eaves | | | | | | | | | |
| Width S (mm) | — | — | 5 | 2 | 2 | 2 | 2 | 2 | 2 |
| Durability | OK | 1380 | 900 | OK | OK | OK | OK | OK | OK |
| Percent defectives | | | | | | | | | |
| Making (%) | 1.1 | 0.9 | 1.5 | 3.8 | 3.5 | 3.3 | 1.8 | 2.8 | 7.8 |
| Irregularity (%) | 55 | 25 | 18 | 1.5 | 1.5 | 3.5 | 5 | 3.3 | 3.3 |
| Positioning (%) | 34 | 35 | 1.9 | 1.2 | 1.3 | 2.5 | 1.4 | 1.3 | 1.3 |

(*1)
A: Ti—4.5Al—3V—2Fe—2Mo
B: Ti—6Al—4V
C: Ti—15V—3Al—3Sn—3Cr

As apparent from the test results, when the eaves was not provided, it was very difficult to butt weld the very thin crown plate to the flange part and the joint setting and deformation by heat were occurred in a large percentage. Further, there is a tendency for the weld junction to lack a necessary strength. In contrast, the club heads according to the present invention had no trouble with the welding and durability.

As described above, in the golf club heads according to the present invention, as the eaves is formed along the upper edge of the opening, the front edge of the crown portion has a crank-shaped cross sectional shape. Accordingly, this part is increased in the bending rigidity. Therefore, although the thickness is very small, collapse and deformation of the front edge of the crown portion (the front edge of the crown plate or traverse part) due to the heat applied during welding and also due to the force applied during assembling and welding can be effectively prevented. Thus, it is possible to use the above-mentioned very thin metal material for the crown plate.

What is claimed is:

1. A hollow golf club head comprising a main body, a crown plate, and a face plate;

said main body, crown plate and face plate each made of a metal material;

the main body containing a hosel part, a sole part and a side part extending upwards from the periphery of the sole part except for a front edge of the sole part thereby defining an open top and an open front;

the crown plate being welded to the main body and covering said open top, whereby an opening is formed on the front thereof;

the face plate being welded to the main body to cover said opening on the front;

the face plate containing a face part defining a clubface, and a flange part extending backward from at least an upper edge of the face part wherein the crown plate is provided with an eave which includes a part extending downwardly from the front edge thereof and a backing extending part forward from the lower end of the downwardly extending part along the inside of the flange part; and the thickness of the crown plate is in a range of from 0.3 to 1.5 mm.

2. The golf club head according to claim 1, wherein the width of the backing part is in a range of from 2 to 5 mm.

3. The golf club head according to claim 1, wherein at least one of the front face of the downwardly extending part and the rear face of the flange part is inclined so as to form a groove for welding.

4. The golf club head according to claim 1, wherein said main body is formed by casting a metal material, and said crown plate is formed by pressing a metal plate.

5. The golf club head according to claim 1, wherein the face plate is made of a titanium alloy, and the crown plate is made of a titanium alloy.

6. The golf club head of claim 1, wherein the downwardly extending part and backing part define a continuous stepped configuration which extends across the top of the crown plate to engage with the overlapping flange of the face plate.

7. The golf club head of claim 6, wherein the stepped configuration is discontinuous.

8. The golf club head of claim 1, wherein the flange part contains a stopper for defining the space between the rear face of the flange and the eave for receiving weld material.

9. A hollow golf club head comprising a main body, a crown plate and a face plate;

said main body, crown plate and face plate each made of a metal material;

the main body containing a hosel part, a sole part and a side part extending upwards from the periphery of the sole part except for a front edge of the sole part thereby defining an open top and an open front;

the crown plate being welded to the main body and covering said open top, whereby an opening is formed on the front thereof, said main body containing a transverse part separating the open top from the open front and defining an upper edge of the open front;

the crown plate being welded to the main body, covering said open top;

the crown plate having a thickness in the range of from 0.3 to 1.5 mm;

the face plate being welded to the main body to cover said open front;

the face plate containing a face part defining a clubface, and a flange part extending backward from at least an upper edge of the face part;

said transverse part provided with a part extending downwardly from the front edge thereof and a backing part extending forward from the lower end of the downwardly extending part along the inside of the flange part; and the thickness of the transverse part is in a range of from 0.3 to 1.5 mm.

10. The golf club head according to claim 9, wherein the width of the backing part is in a range of from 2 to 5 mm.

11. A golf club head according to claim 9, wherein at least one of the front face of the downwardly extending part and the rear face of the flange part is inclined so as to form a groove for welding.

12. The golf club head according to claim 9, wherein said main body is formed by casting a metal material, and said crown plate is formed by pressing a metal plate.

13. The golf club head according to claim 9, wherein the face plate is made of a titanium alloy, and the crown plate is made of a titanium alloy.

14. The golf club head of claim 9, wherein the transverse part defines a continuous stepped configuration which extends across the top of the face plate to engage with the overlapping flange of the face plate.

15. The golf club head of claim 14, wherein the stepped configuration is discontinuous.

* * * * *